US006045917A

United States Patent [19]

Missell et al.

[11] Patent Number: 6,045,917

[45] Date of Patent: Apr. 4, 2000

[54] INK JET RECORDING ELEMENT

[75] Inventors: Gregory E. Missell, Penfield; David E. Decker, Rochester, both of N.Y.

[73] Assignee: Eastman Kodak Company, Rochester, N.Y.

[21] Appl. No.: 09/114,022

[22] Filed: Jul. 10, 1998

[51] Int. Cl.[7] ..... B41M 5/00

[52] U.S. Cl. ..... 428/411.1; 428/195; 428/478.2; 428/478.4; 428/480; 428/500; 428/507; 428/522

[58] Field of Search ..... 428/411.1, 195, 428/478.2, 478.4, 522, 480, 500, 507

[56] References Cited

U.S. PATENT DOCUMENTS 3,958,995 5/1976 Campbell et al. ..... 96/84
5,789,050 8/1998 Shaw-Klein et al. ..... 428/216

*Primary Examiner*—Pamela R. Schwartz
*Attorney, Agent, or Firm*—Harold E. Cole

[57] ABSTRACT

An ink jet recording element comprising a support having thereon, in the order recited, a base layer comprising a hydrophilic material and an ink-receptive top layer comprising a mordant polymer having the following formula:

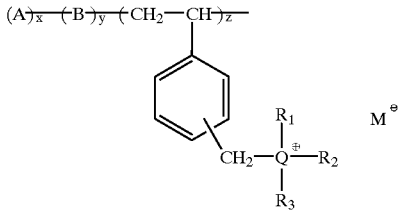

wherein:

A represents units of an addition polymerizable monomer containing at least two ethylenically unsaturated groups;

B represents units of a copolymerizable, α,β-ethylenically unsaturated monomer;

Q is N or P;

$R_1$, $R_2$ and $R_3$ each independently represents a carbocyclic or alkyl group;

$M^-$ is an anion;

x is from about 0.25 to about 5 mole percent;

y is from about 0 to about 90 mole percent; and z is from about 10 to about 99 mole percent.

12 Claims, No Drawings

INK JET RECORDING ELEMENT

FIELD OF THE INVENTION

This invention relates to an ink jet recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have severely limited their commercial usefulness. The requirements for an image recording medium or element for ink jet recording are very demanding.

It is well known that in order to achieve and maintain photographic-quality images on such an image-recording element, an ink jet recording element must:

- Be readily wetted so there is no puddling, i.e., coalescence of adjacent ink dots, which leads to nonuniform density
- Exhibit no image bleeding
- Exhibit the ability to absorb high concentrations of ink and dry quickly to avoid elements blocking together when stacked against subsequent prints or other surfaces
- Provide a high level of gloss and avoid differential gloss
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light It has been observed that in certain ink jet image recording elements, the imaged or "inked" areas will experience a color or hue shift when exposed to high humidity and/or slow drying conditions. This hue shift is also dependent upon the specific ink sets from different manufacturers. The cause of this hue shift is a result of the dyes having sufficient moisture in the ink-receiving layer of the media to allow the dyes to continue to migrate or spread with time in the ink-receiving layer. An image that is exposed to high humidity or very slow drying conditions, or covered after being printed thus slowing drying, will experience a hue or color shift over time.

DESCRIPTION OF RELATED ART

U.S. Pat. No. 05,789,070, of Shaw-Klein et al., filed Dec. 11, 1996 relates to an ink jet recording element comprising a support coated with a water-absorbing base coating and an overcoat layer of a cationically-modified cellulose ether.

While this element provides satisfactory results in most instances, there is a problem with this element when used at high humidity and/or slow drying conditions with certain printers and certain inks. Under such conditions, a hue shift has been observed which is objectionable.

U.S. Pat. No. 3,958,995 relates to photographic elements containing cross-linked mordants. However, there is no disclosure in this patent that these mordants would be useful in an ink jet recording element.

It is an object of this invention to provide an ink jet recording element which has less of a color shift when used at high humidity and/or slow drying conditions.

SUMMARY OF THE INVENTION

This and other objects are provided by the present invention comprising an ink jet recording element comprising a support having thereon, in the order recited, a base layer comprising a hydrophilic material and an ink-receptive top layer comprising a mordant polymer having the following formula:

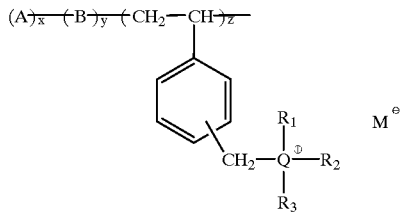

wherein:

A represents units of an addition polymerizable monomer containing at least two ethylenically unsaturated groups;

B represents units of a copolymerizable, α,β-ethylenically unsaturated monomer;

Q is N or P;

$R_1$, $R_2$ and $R_3$ each independently represents a carbocyclic or alkyl group;

$M^-$ is an anion;

x is from about 0.25 to about 5 mole percent, preferably 1.0 to 5.0 mole percent;

y is from about 0 to about 90 mole percent, preferably 0 to 45 mole percent; and z is from about 10 to about 99 mole percent, preferably 40 to 90 mole percent.

By use of the invention, ink jet recording elements are obtained which have less of a color shift when used at high humidity and/or slow drying conditions.

DETAILED DESCRIPTION OF THE INVENTION

The mordant polymer described above may be used in any amount effective for the intended purpose. In general, good results have been obtained when the mordant polymer is present in an amount of about 5% to about 25% by weight of the top layer, preferably about 10%.

The addition of the mordant to the overcoat layer does not degrade other performance features such as dry time, lightfastness, coalescence, bleeding, adhesion of the layers, waterfastness, and gloss when printed with a variety of ink jet inks.

Preferred mordant polymers used in the invention comprise units having the formula above wherein A is a repeating unit of an addition polymerizable monomer containing at least two ethylenically unsaturated groups, such as vinyl groups generally having the following structure:

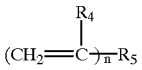

wherein n is from 1 to about 10, preferably 2 or 3; each $R_4$ independently represents hydrogen or methyl; and $R_5$ is a linking group comprising one or more condensation linkages such as amide, sulfonamide, esters such as sulfonic acid ester, arylene etc., or a condensation linkage and an organic nucleus such as alkylene, e.g., methylene, ethylene, trimethylene, arylene, etc.

Suitable monomers from which the repeating units of A are formed include divinylbenzene, allyl acrylate, allyl methacrylate, N-allylmethacrylamide, etc.

B in the above formula is a unit of a copolymerizable α,β-ethylenically unsaturated monomer (including two, three or more repeating units), such as ethylene, propylene, 1-butene, isobutene, 2-methylplentene, etc. A preferred class of ethylenically unsaturated monomers which may be used include the lower 1-alkenes having from 1 to about 6 carbon atoms; styrene, and tetramethylbutadiene and methyl methacrylate.

$R_1$, $R_2$ and $R_3$ in the above formula each independently represents a carbocyclic group such as aryl, aralkyl, and cycloalkyl such as benzyl, phenyl, p-methyl-benzyl, cyclopentyl, etc.; or an alkyl group preferably containing from 1 to about 20 carbon atoms such as methyl, ethyl, propyl, isobutyl, pentyl, hexyl, heptyl, decyl, etc. In a preferred embodiment, $R_1$ and $R_2$ are methyl and $R_3$ is benzyl.

$M^-$ in the above formula is an anion, i.e., a negative salt forming an ionic radical or atom such as a halide, e.g., bromide or chloride, sulfate, alkyl sulfate, alkane or arene sulfonate, acetate, phosphate, etc.

Further examples of the mordant polymers useful in the invention and preparation of the above polymers are found in U.S. Pat. No. 3,958,995, the disclosure of which is hereby incorporated by reference. Specific examples of the major components of such mordant polymers include the following:

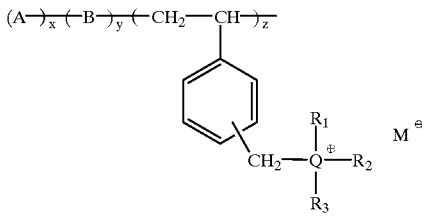

| Mordant | A | B | $R_1$ | $R_2$ | $R_3$ |
|---|---|---|---|---|---|
| 1 | $C_6H_4(CH{=}CH_2)_2$ | $C_6H_5{-}CH{=}CH_2$ | $CH_3$ | $CH_3$ | $CH_2C_6H_5$ |
| 2 | $C_6H_4(CH{=}CH_2)_2$ | $C_6H_5{-}CH{=}CH_2$ | $CH_3$ | $CH_3$ | $CH_3$ |
| 3 | $C_6H_4(CH{=}CH_2)_2$ | $C_6H_5{-}CH{=}CH_2$ | $CH_3$ | $CH_3$ | $(CH_3)_2{-}CHCH_2$ |
| 4 | $C_6H_4(CH{=}CH_2)_2$ | $C_6H_5{-}CH{=}CH_2$ | $(CH_3)_2{-}CHCH_2$ | $(CH_3)_2{-}CHCH_2$ | $(CH_3)_2{-}CHCH_2OH$ |
| 5 | $C_6H_4(CH{=}CH_2)_2$ | $H_2C{=}C(CH_3)CO_2{-}CH_3$ | $CH_3$ | $CH_3$ | $CH_2C_6H_5{-}OH$ |
| 6 | $(H_2C{=}C(CH_3){-}CO_2CH_2)_2$ | $H_2C{=}C(CH_3)CO_2{-}CH_3$ | $CH_3$ | $CH_3$ | $CH_2C_6H_5$ |

Other compatible polymers and/or fillers may be added to the top coat of the recording element of the invention to enhance particular performance aspects dependent upon the end use. Polymers which may be used include nonionic cellulose ethers, anionic cellulose ethers, polyvinyl alcohol, sulfonated polyesters, polyvinylpyrrolidone and the like. The top layer generally has a thickness of about 0.1 to about 2.0 μm.

For example, the top layer of the recording element of the invention may contain, in addition to the mordant polymer, other materials such as methyl cellulose, e.g., A4M (Dow Chemical Co.) and hydroxyethyl cellulose, such as JR400 (hydroxyethyl cellulose reacted with a trimethyl ammonium chloride substituted epoxide from Amerchol Corp.) in a weight ratio of 80/20. These materials may be used in amounts from about 0.75 $g/m^2$ to about 1.25 $g/m^2$, preferably from about 1 $g/m^2$ to about 1.1 $g/m^2$.

In a preferred embodiment of the invention, the hydroxyethyl cellulose employed is a cationically-modified cellulose ether as described in U.S. Pat. No. 5,789,070, of Shaw-Klein et al., filed Dec. 11, 1996, having the structure:

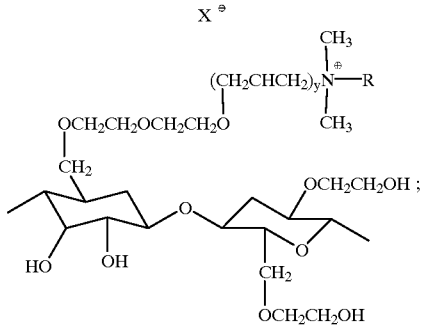

wherein

R represents $C_nH_{2n+1}$;

X represent halide anion; and y is 1 to about 30.

The top layer may contain about 5 to about 75 weight percent of the cationically-modified cellulose ether described above. Useful cationically-modified cellulose ether polymers include Celquat® SC240C (hydroxyethyl cellulose reacted with trimethylammonium chloride substituted epoxide from National Starch and Chemical Co.) and Quatrisoft® LM-200 (hydroxyethyl cellulose reacted with a dodecyl dimethylammonium chloride substituted epoxide from Amerchol Corp.).

The base layer is primarily intended to act as a sponge layer for the absorption of ink solvent. As such, it is primarily composed of hydrophilic or porous materials. Generally, the base layer has a thickness of about 3 to about 20 $\mu$m, and is present in an amount from about 5 g/m$^2$ to about 7 g/m$^2$, preferably from about 5.3 g/m$^2$ to about 5.5 g/m$^2$. Suitable hydrophilic materials include gelatin, acetylated gelatin, phthalated gelatin, oxidized gelatin, chitosan, poly(alkylene oxide), poly(vinyl alcohol), modified poly (vinyl alcohol), sulfonated polyester, partially hydrolyzed poly(vinylacetate/ vinyl alcohol), poly(acrylic acid), poly(1-vinylpyrrolidone), poly(sodium styrene sulfonate), poly(2-acrylamido-2-methane sulfonic acid), or polyacrylamide or mixtures thereof. Copolymers of these polymers with hydrophobic monomers may also be used.

The pH of the base layer may be adjusted to optimize swelling (water capacity), to enhance gloss or to minimize dye migration. For example, the pH of the layer may be reduced to 3.5 to improve swelling capacity, thereby reducing ink drying times, and to impart waterfastness. In another embodiment, the pH of the image recording layer may be raised to 8.5 in order to enhance gloss and reduce bronzing due to surface dye crystallization.

In a preferred embodiment of the invention, the base layer is 50%–100% photographic-grade gelatin, modified so that the pH is far from the isoelectric point of the gelatin, so that water uptake may be maximized. The remainder of the layer may consist of a polymer or inorganic material compatible with the gelatin which does not adversely impact functional properties.

If desired, the base layer of the recording element of the invention may be made porous by the addition of ceramic or hard polymeric particulates, by foaming or blowing during coating, or by inducing phase separation in the layer through introduction of a nonsolvent. In addition, rigidity may be imparted to the base layer through incorporation of a second phase such as polyesters, poly(methacrylates), polyvinyl benzene- containing copolymers and the like.

In the present invention, the recording element can be opaque, translucent, or transparent. Thus, the supports utilized in the recording element of the present invention are not particularly limited and various supports may be employed. Accordingly, plain papers, resin-coated papers, various plastics including a polyester-type resin such as poly(ethylene terephthalate), poly(ethylene naphthalate) and polyester diacetate, a polycarbonate-type resin, a fluorine-type resin such as polytetrafluoroethylene, metal foil, various glass materials, and the like can be employed as supports. When the supports of the present invention are transparent, a transparent recording element can be obtained and used as a transparency in an overhead projector. The thickness of the support employed in the invention can be from about 12 to about 500 $\mu$m, preferably from about 75 to about 300 $\mu$m.

If desired, in order to improve the adhesion of the base layer to the support, the surface of the support may be corona-discharge-treated prior to applying the base layer or solvent-absorbing layer to the support. Alternatively, an under-coating, such as a layer formed from a halogenated phenol or a partially hydrolyzed vinyl chloride-vinyl acetate copolymer can be applied to the surface of the support.

Since the image recording element may come in contact with other image recording articles or the drive or transport mechanisms of image recording devices, additives such as surfactants, lubricants, matte particles and the like may be added to the element to the extent that they do not degrade the properties of interest.

The layers described above, including the base layer and the top layer, may be coated by conventional coating means onto a support material commonly used in this art. Coating methods may include, but are not limited to, wound wire rod coating, slot coating, slide hopper coating, gravure, curtain coating and the like. Some of these methods allow for simultaneous coatings of both layers, which is preferred from a manufacturing economic perspective.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following example further illustrates the invention.

EXAMPLE

Element 1—Control

This recording element was prepared by slot coating. The base layer was coated from a 10% solids aqueous formulation directly on corona discharge-treated, photographic grade, polyethylene-coated paper and dried thoroughly at 100° C. The final dry coverage of the base layer was 5.4 g/m$^2$. The image recording layer (top layer) was coated directly over the base layer in a second pass from coating formulations ranging from 1 to 2% solids. The latter layer was dried under identical conditions to the base layer. The dry coverage of the image receiving layer (top layer) was 1.1 g/m$^2$.

The base layer of the element was a mixture of 60% by weight lime-process ossein photographic grade gelatin, 30% polyvinylpyrrolidone (PVP K-90, ISP) and 10% by weight of mordant C-2 (see below). The pH of the coating formulation was adjusted to 3.5 by direct addition of hydrochloric acid (36–38%, J T Baker).

The top layer of the element was a 20/80% mixture of methyl cellulose (A4M) (Dow Chemical Co.) and hydroxyethyl cellulose (Quatrisoft® LM200, Amerchol Corp.).

The following closely-related comparison mordants were used in the comparison elements to illustrate that not all mordants are useful:

C-1: poly(N,N-dimethylcyclohexyl vinylbenzyl) ammonium chloride

C-2: poly(N-vinyl benzyl-N,N,N-trimethyl ammonium chloride-co-ethyleneglycol dimethacrylate)

Element 2—Comparison

This element is the same as Control Element 1 except that comparison mordant C-1 was added to the top coat layer at 10% by weight and coated over the base as described above. The surfactants Olin 10 G (Dixie Chemicals Corp.) and FS-300 (Zonyl®, DuPont Corp.) were added to help coatability.

Element 3—Comparison

This element is the same as Element 2 except that comparison mordant C-2 was used.

Element 4—Invention

This element is the same as Element 1 except that mordant 1 was used.

Each element was then imaged on an Epson 600 Ink Jet Printer at 300×600 dpi with Standard Epson 600 Inks, cyan, magenta and yellow (U.S. Pat. Nos. 5,158,377; 5,221,148 and 5,421,658) and a Lexmark 7000 Ink Jet Printer at 300×600 dpi with Lexmark Photo Inks, cyan, magenta and yellow (U.S. Pat. Nos. 5,364,461; 5,254,160 and 5,497,178). One print was dried at 21° C. and 50% RH for 24 hours, and another print was dried at 26° C. and 80% RH for 24 hours.

To measure the hue shift, the color space system, measuring the axis of L*, a*, b* was used. The a* and b* values, which measure the hue shift, where a* goes from −a, being green, to +a being red; and −b, being blue, to +b being yellow, were measured at both drying conditions. The delta of the two drying conditions was then calculated to show the shift along the "a" and "b" axis. The + or − sign of the delta indicates the color of the shift on each axis and the absolute value indicates the magnitude of the shift. The smaller the delta, the less of a hue shift. The results are shown in the following Tables:

TABLE 1

Lexmark 7000 Printer

| Element | Drying @ 21° C., 50% RH | | Drying @ 26° C., 80% RH | | | |
|---|---|---|---|---|---|---|
| (Mordant) | a* | b* | a* | b* | Delta a* | Delta b* |
| 1 (None) | −8.1 | 2.3 | −12.3 | 19.0 | −4.2 | 16.7 |
| 2 (C-1) | −9.8 | 4.1 | −11.8 | 15.7 | −2 | 11.6 |
| 3 (C-2) | 8.3 | 8.9 | 10.4 | 11.6 | −2.1 | 2.7 |
| 4 (1) | −9.3 | −0.6 | −10.2 | 1.0 | −0.9 | 1.6 |

TABLE 2

Epson 600 Printer

| Element | Drying @ 21° C., 50% RH | | Drying @ 26° C., 80% RH | | | |
|---|---|---|---|---|---|---|
| (Mordant) | a* | b* | a* | b* | Delta a* | Delta b* |
| 1 (None) | −9.4 | 2.7 | −16 | 21.5 | −6.6 | 18.8 |
| 2 (C-1) | −10.3 | −7.2 | −12.7 | −4.5 | −2.4 | 2.7 |
| 3 (C-2) | −10 | 1.3 | −12 | 3.7 | −2 | 2.4 |
| 4 (1) | −8.9 | −8.2 | −9.1 | −7.1 | −0.2 | 1.1 |

The above results show that use of the mordant of the invention had a much smaller hue shift (Delta a* and Delta b*) than the control element with no mordant and the comparison elements with the comparison mordants.

This invention has been described with particular reference to preferred embodiments thereof but it will be understood that modifications can be made within the spirit and scope of the invention.

What is claimed is:

1. An ink jet recording element comprising a support having thereon, in the order recited, a base layer comprising a hydrophilic material and an ink-receptive top layer comprising a mordant polymer having the following formula:

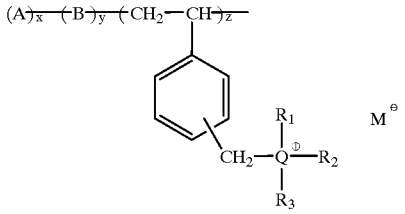

wherein:

A represents units of an addition polymerizable monomer containing at least two ethylenically unsaturated groups;

B represents units of a copolymerizable, α,β-ethylenically unsaturated monomer;

Q is N or P;

$R_1$, $R_2$ and $R_3$ each independently represents a carbocyclic or alkyl group;

$M^-$ is an anion;

x is from about 0.25 to about 5 mole percent;

y is from about 0 to about 90 mole percent; and z is from about 10 to about 99 mole percent.

2. The element of claim 1 wherein A is a repeating unit of an addition polymerizable monomer containing at least two ethylenically unsaturated groups having the following structure:

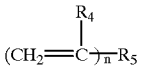

wherein n is an integer from 1 to about 10; each $R_4$ independently represents hydrogen or methyl; and $R_5$ is a linking group comprising one or more condensation linkages.

3. The element of claim 1 wherein Q is N, $R_1$ and $R_2$ are each methyl, $R_3$ is benzyl, A is a unit of a divinylbenzene monomer, and B is a repeating unit of styrene.

4. The element of claim 1 wherein said mordant polymer is present at a concentration of about 5% to about 25% by weight of said top layer.

5. The element of claim 1 wherein said base layer is gelatin, acetylated gelatin, phthalated gelatin, oxidized gelatin, chitosan, poly(alkylene oxide), poly(vinyl alcohol), modified poly(vinyl alcohol), sulfonated polyester, partially hydrolyzed poly(vinylacetate/vinyl alcohol), poly(acrylic acid), poly(1-vinylpyrrolidone), poly(sodium styrene sulfonate), poly(2-acrylamido-2-methane sulfonic acid), or polyacrylamide or mixtures thereof.

6. The element of claim 1 wherein said base layer comprises gelatin.

7. The element of claim 1 wherein said base layer has a thickness of 3 to 20 $\mu$m and said top layer has a thickness of 0.1 to 2 $\mu$m.

8. The element of claim 1 wherein said base layer, said top layer or both include matte particles.

9. The element of claim 1 wherein said top layer also contains methyl cellulose and hydroxyethyl cellulose.

10. The element of claim 9 wherein said hydroxyethyl cellulose is a cationically modified cellulose ether having the structure:

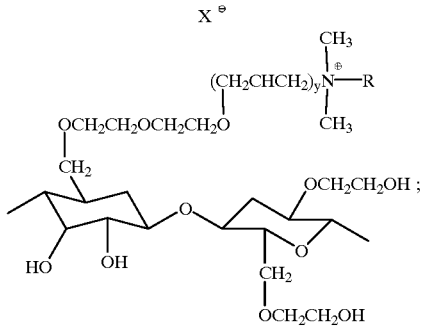

wherein

R represents $C_nH_{2n+1}$;

X represent halide anion; and y is 1 to about 30.

11. The element of claim 10 wherein y is 1–12 and X is chloride.

12. The element of claim 10 wherein said cationically modified cellulose ether is a hydroxyethyl cellulose reacted with trimethylammonium chloride substituted epoxide or hydroxyethyl cellulose reacted with a dodecyl dimethylammonium chloride substituted epoxide.

* * * * *